US010764669B2

(12) United States Patent
Kim

(10) Patent No.: US 10,764,669 B2
(45) Date of Patent: Sep. 1, 2020

(54) DEVICE AND METHOD FOR MONITORING EARPHONE WEARING STATE

(71) Applicant: Orfeo SoundWorks Corporation, Anyang (KR)

(72) Inventor: Eundong Kim, Uiwang (KR)

(73) Assignee: ORFEO SOUNDWORKS CORPORATION, Anyang (KR)

( * ) Notice: Subject to any disclaimer, the term of this patent is extended or adjusted under 35 U.S.C. 154(b) by 0 days.

(21) Appl. No.: 16/321,910

(22) PCT Filed: Nov. 30, 2016

(86) PCT No.: PCT/KR2016/013994
§ 371 (c)(1),
(2) Date: Jan. 30, 2019

(87) PCT Pub. No.: WO2018/030589
PCT Pub. Date: Feb. 15, 2018

(65) Prior Publication Data

US 2020/0107104 A1 Apr. 2, 2020

(30) Foreign Application Priority Data

Aug. 11, 2016 (KR) ..... 10-2016-0102392

(51) Int. Cl.
*H04R 1/10* (2006.01)
*G08B 3/10* (2006.01)
(Continued)

(52) U.S. Cl.
CPC ..... *H04R 1/1041* (2013.01); *G08B 3/10* (2013.01); *G10L 25/51* (2013.01); *H04R 3/04* (2013.01); *H04R 29/001* (2013.01)

(58) Field of Classification Search
CPC ..... H04R 1/1041; H04R 3/04; H04R 29/001; G08B 3/10; G10L 25/51
(Continued)

(56) References Cited

U.S. PATENT DOCUMENTS

2006/0064037 A1* 3/2006 Shalon ..... A61B 5/0006 600/586
2010/0119077 A1 5/2010 Platz et al.
(Continued)

FOREIGN PATENT DOCUMENTS

JP 11-024690 A 1/1999
JP H1124690 A * 1/1999
(Continued)

*Primary Examiner* — William A Jerez Lora
(74) *Attorney, Agent, or Firm* — Patent Office of Dr. Chung Park

(57) ABSTRACT

Disclosed is a device and method for monitoring an earphone wearing state. A device and method for monitoring an earphone wearing state according to the present invention comprises: an internal microphone for receiving an internal voice generated inside an ear and generating an internal voice signal; an external microphone for receiving an external sound selectively including external noise and an external voice transferred from a vocal cords to the outside of an oral cavity and generating an external sound signal; a control unit for determining the volume of external noise though a comparison between an internal voice signal and an external sound signal and determining whether to generate an alarm signal; and an alarm unit for performing alarming in response to an alarm signal.

6 Claims, 5 Drawing Sheets

(51) Int. Cl.
*G10L 25/51* (2013.01)
*H04R 3/04* (2006.01)
*H04R 29/00* (2006.01)

(58) Field of Classification Search
USPC .... 381/56, 58, 71.1, 71.11, 71.6, 94.1, 94.7, 381/124
See application file for complete search history.

(56) References Cited

U.S. PATENT DOCUMENTS

2012/0197635 A1* 8/2012 Nystrom ..... H04R 1/1016 704/201
2013/0329895 A1 12/2013 Dusan et al.

FOREIGN PATENT DOCUMENTS

KR 10-2006-0018030 A 2/2006
KR 10-2008-0069400 A 7/2008

* cited by examiner

DEVICE AND METHOD FOR MONITORING EARPHONE WEARING STATE

CROSS-REFERENCE TO PRIOR APPLICATIONS

This application is a national Stage Patent Application of PCT International Patent Application No. PCT/KR2016/013994, filed on Nov. 30, 2016 under 35 U.S.C. § 371, which claims priority of Korean Patent Application No. 10-2016-0102392, filed on Aug. 11, 2016, which are all hereby incorporated by reference in their entirety.

TECHNICAL FIELD

The present invention relates to a technique of sensing a state of wearing earphones, more specifically, to a device and method for monitoring an earphone wearing state, which informs a degree of tightly attaching earphones to ear canals.

BACKGROUND ART

Earphones may be largely divided into open-type earphones and canal-type earphones.

Since the open-type earphones have a structure leaking a large amount of low-pitched sounds, the canal-type earphones are used much recently. The canal-type earphones have a structure of being inserted into the ear canals, have an excellent sensation of wearing, and can minimize leaking of low-pitched sounds as they are tightly attached to the ear canals.

Therefore, the canal-type earphones tend to be manufactured considering the shape of ear canals.

However, since the size and shape of ear canals vary from person to person, there is a problem in that it is practically difficult for an individual user to choose canal-type earphones fitted the user perfectly.

Meanwhile, a user may experience that low-pitched sounds are enhanced when general earphones including the canal-type earphones are pressed into the ears (inner ears). That is, it is known that strength of reproducing the low-pitched sounds is changed according to a degree of tightly attaching the earphones to the ears.

Like this, when attachment of the earphones to the ear canals is not solid, it is difficult to expect reproduction of high-quality sounds. Moreover, there is a tendency of turning the volume up to compensate for the leaking sound. This may be harmful to the ears. That is, it may lead to noise deafness. In addition, since external noises may leak into when attachment of the earphones to the ear canals is not solid, there is a tendency of turning the volume up to properly hear the sounds outputted from the earphones. That is, a user may also turn the volume up when the external noises are loud.

In addition, the external noises act as an obstacle in reproducing high-quality sounds. Although a technique of measuring external noises has been proposed before, there is a problem in that it is difficult to distinguish external noises from the voices of a human being since a microphone which measures the external noises receives the voices of a human being together with the external noises. Like this, there is a limit in improving sound quality due to the difficulties in measuring the external noises.

Since it is difficult to treat or recover auditory cells once they are damaged, a measure for determining whether the earphones are properly worn on (tightly attached to) the ears is needed to reproduce high-quality sounds at a proper sound volume. In addition, there also needs a measure for improving sound quality through correct measurement of external noise when a user makes a phone call or listens to music.

DISCLOSURE OF INVENTION

Technical Problem

An object of the present invention is to provide a device and method for monitoring an earphone wearing state, which can monitor a time point of generating a voice of a user, distinguish the user's voice from external noises, determine an attached state of earphones from a measurement value of the external noises, and issue an alarm.

Technical Solution

To accomplish the above object, according to one aspect of the present invention, there is provided a device for monitoring an earphone wearing state, the device including: an internal microphone for receiving an internal voice generated inside an ear and generating an internal voice signal; an external microphone for receiving an external sound selectively including an external voice, transferred from the vocal cords to the outside of the oral cavity, and an external noise, and generating an external sound signal; a control unit for determining an external noise level though a comparison between the internal voice signal and the external sound signal, and determining whether or not to generate an alarm signal; and an alarm unit for generating an alarm in response to the alarm signal.

At this point, the control unit may include: an internal voice generation determination unit for determining whether an internal voice is generated; a noise existence determination unit for determining whether an external noise is included in the external sound using a difference between the external sound signal and the internal voice signal, when an internal voice is generated; an internal voice restoration unit for restoring an original voice from the internal voice signal and generating a restored voice signal, when an external noise is included in the external sound; a noise level measurement unit for measuring an external noise level from a difference between the restored voice signal and the external sound signal and external sound signals generated at a time point other than the time of generating the internal voice signal; an alarm signal generation unit for comparing the measured noise level with a value set in advance, and generating an alarm signal when the noise level is equal to or higher than the set value; and a sound processing unit for comparing, when an external noise is not included in the external sound, the measured noise level with the value set in advance and selectively processing the internal voice signal and the external voice signal when the noise level is lower than the set value.

Here, the internal voice restoration unit may include: a first linear prediction analysis unit for determining an excitation signal from an inputted super-narrowband signal; an excitation signal extension unit for generating a sound by outputting the determined excitation signal as a wideband excitation signal through a spectrum folding technique or a Gaussian noise pass band conversion technique; a high frequency spectrum extension unit for extending a super-narrowband signal to a wideband signal including a high frequency band signal by multiplying the frequency of the super-narrowband signal; a second linear prediction analysis unit for predicting and determining the high frequency band signal from the extended wideband signal; a filtering unit for filtering the high frequency band signal; a synthesis unit for synthesizing the high frequency band signal outputted from the filtering unit and the wideband excitation signal outputted from the excitation signal extension unit; and a mixing unit for mixing the high frequency signal outputted from the synthesis unit and the super-narrowband signal.

Meanwhile, a method of monitoring an earphone wearing state according to the present invention performs the steps of: receiving an internal voice signal generated by receiving an internal voice generated inside an ear from an internal microphone, and receiving an external sound signal generated by receiving an external sound selectively including an external voice, transferred from vocal cords to the outside of an oral cavity, and an external noise from an external microphone, by a controller; and determining existence and a level of the external noise from the internal voice signal and the external sound signal, and determining whether or not to generate an alarm signal.

At this point, a signal exceeding a narrowband low frequency signal generated by the internal microphone may be regarded as an external noise. In addition, if the internal voice is generated, whether an external noise exists is determined using a difference between an external voice signal, generated by the external voice transferred from the vocal cords to the outside of the oral cavity, and the internal voice signal.

Here, the monitoring method further includes the steps of: restoring, when an external noise exists, an original voice signal from the internal voice signal, measuring a noise level using a difference between the restored voice signal and the external voice signal, and generating an alarm corresponding to the noise level or selectively processing the restored voice signal and the external voice signal; and selectively processing, when an external noise does not exist, the internal voice signal and the external voice signal.

Meanwhile, the monitoring method further includes the steps of: determining, if the internal voice is not generated, whether the external sound is generated; and measuring, if the external sound exists, a noise level of the external sound, and determining whether or not to generate an alarm corresponding to the noise level.

Advantageous Effects

As described above, according to the device and method for monitoring an earphone wearing state of the present invention, since existence of noise can be clearly confirmed using an internal microphone and an external microphone, it can be utilized for reproduction of high-quality sounds.

In addition, since leaking-out of reproduced sounds or leaking-in of external noise is prevented by appropriately wearing again earphones in response to an alarm for an earphone attachment state, high-quality sounds with enhanced low-pitched sounds can be reproduced.

Like this, since high-quality sounds with enhanced low-pitched sounds can be reproduced by wearing again earphones, it does not need to turn up the volume, and thus health of the ears including auditory cells can be maintained.

BEST MODE FOR CARRYING OUT THE INVENTION

Figure 1:
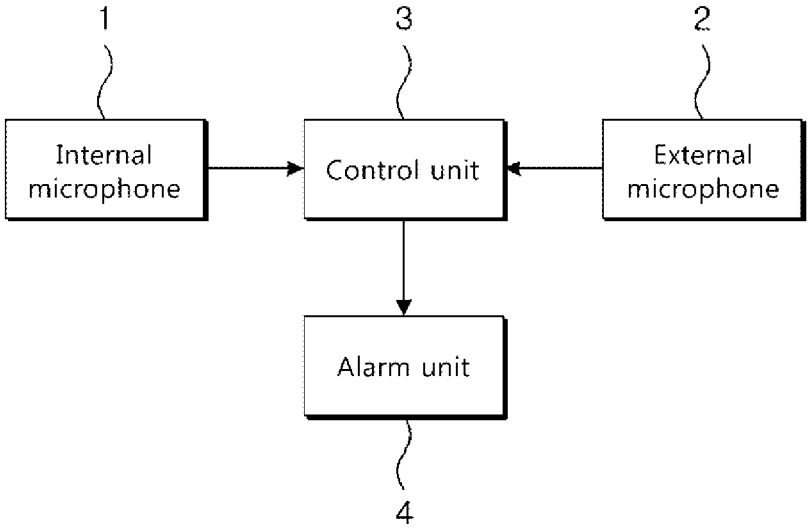
FIG. 1 is a view showing the configuration of a device for monitoring an earphone wearing state according to an embodiment of the present invention.

Hereafter, the present invention will be described in detail with reference to the preferred embodiments and the accompanying drawings of the present invention, and it will be described assuming that like reference numerals denote like elements.

When an element is referred to as "including" another element in the detailed description or the claims of the present invention, it should not be interpreted as being limited only to the corresponding element, but should be understood as further including another element, as far as an opposed description is not specially specified.

In addition, element named as "means", "unit", "module", "block" or the like in the detailed description or the claims of the present invention mean a unit for performing at least one function or operation, and each of the elements may be implemented by software, hardware or a combination these.

Hereinafter, an example of implementing a device and method for monitoring an earphone wearing state of the present invention will be described through a specific embodiment.

FIG. 1 is a view showing the configuration of a device for monitoring an earphone wearing state according to an embodiment of the present invention.

Referring to FIG. 1, a device for monitoring an earphone wearing state according to an embodiment of the present invention includes: an internal microphone 1 for receiving an internal voice generated inside an ear and generating an internal voice signal; an external microphone 2 for receiving an external sound selectively including an external voice, transferred from the vocal cords to the outside of the oral cavity, and an external noise, and generating an external sound signal; a control unit 3 for determining an external noise level though a comparison between the internal voice signal and the external sound signal, and determining whether or not to generate an alarm signal; and an alarm unit 4 for generating an alarm in response to the alarm signal.

The device for monitoring an earphone wearing state of the present invention configured like this installs an internal microphone 1 and an external microphone 2 in the earphone, receives an internal voice generated inside the ear from the internal microphone 1, and generates an internal voice signal. In addition, the external microphone 2 receives an external voice transferred from the vocal cords to the outside of the oral cavity and generates an external sound signal. At this point, if there exists an external noise at the time point of generating the internal voice signal, the external noise is included in the external sound signal. Meanwhile, the control unit 3 determines an external noise level though a comparison between the internal voice signal and the external sound signal and determines whether or not to generate an alarm signal according to the external noise level. When the control unit 3 generates an alarm signal, the alarm unit 4 outputs an alarm sound to the earphone.

Figure 2:
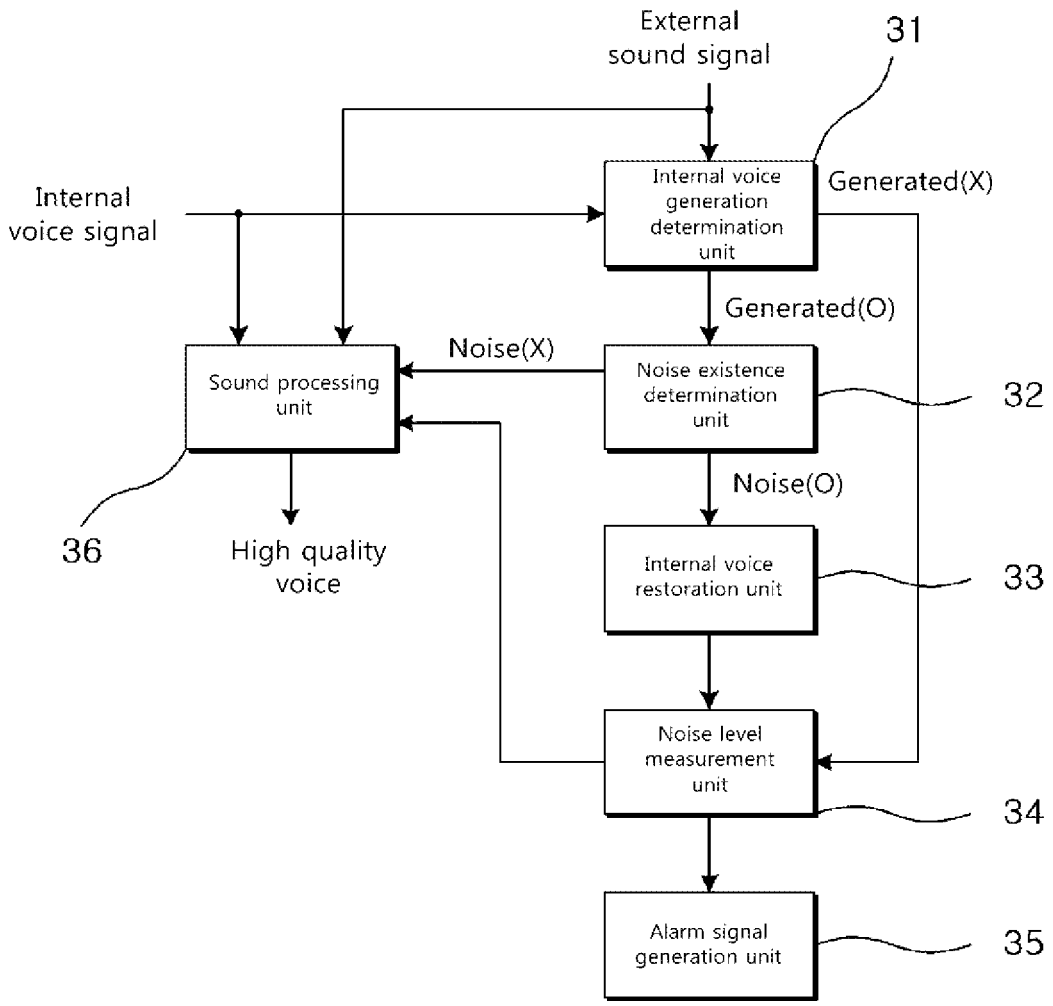
FIG. 2 is a view showing the configuration of a control unit according to an embodiment of the present invention.

FIG. 2 is a view showing the configuration of a control unit according to an embodiment of the present invention.

Referring to FIG. 2, the control unit 3 of the present invention includes: an internal voice generation determination unit 31 for determining whether an internal voice is generated; a noise existence determination unit 32 for determining whether an external noise is included in the external sound using a difference between the external sound signal and the internal voice signal, when an internal voice is generated; an internal voice restoration unit 33 for restoring an original voice from the internal voice signal and generating a restored voice signal, when an external noise is included in the external sound; a noise level measurement unit 34 for measuring an external noise level from a difference between the restored voice signal and the external sound signal and external sound signals generated at a time point other than the time of generating the internal voice signal; an alarm signal generation unit 35 for comparing the measured noise level with a value set in advance, and generating an alarm signal when the noise level is equal to or higher than the set value; and a sound processing unit 36 for comparing, when an external noise is not included in the external sound, the measured noise level with the value set in advance and selectively processing the internal voice signal and the external voice signal when the noise level is lower than the set value.

In the control unit 3 of the present invention configured like this, the internal voice generation determination unit 31 first determines whether an internal voice is generated. If the internal voice is not generated, it means that a user does not make a voice. Therefore, an internal voice signal is not generated. However, an external noise may be generated, and thus an external sound signal may be generated. Since only the external noise exists in this case, the external sound signal is transferred to the noise level measurement unit 34, and a noise level is measured. If the noise level measurement unit 34 determines that the noise level is equal to or higher than a set value, the alarm signal generation unit 35 generates an alarm signal. On the other hand, if the noise level measurement unit 34 determines that the noise level is lower than the set value, the alarm signal will not be generated.

On the other hand, if an internal voice is generated, an external sound is also generated without fail. At this point, whether an external noise is included in the external sound should be confirmed. Therefore, the noise existence determination unit 32 determines whether an external noise is included in the external sound using a difference between the external sound signal and the internal voice signal. Whether an external noise is included may be determined such that if the external noise exceeds a predetermined range from a reference value defined by a difference between the external sound signal and the internal voice signal, which is obtained by making a voice in a quiet place or in a soundproof room, it may be determined that an external noise is included. Although existence of external noise is confirmed using a difference between the external sound signal and the internal voice signal in this embodiment, since the internal voice signal is a narrow-band low frequency signal although every person has a small difference in the internal voice frequency, a sound of a high frequency exceeding the internal voice frequency may be regarded as a noise. This means that the external noise may be measured using only the internal microphone 1.

If it is determined that an external noise is not included in the external sound, the sound processing unit 36 is driven, and the internal voice signal and the external voice signal are selectively processed. On the other hand, if it is determined that an external noise is included in the external sound, an original sound is restored from the internal voice signal through the internal voice restoration unit 33, and a restored voice signal is generated. Subsequently, if the noise level measurement unit 34 measures a difference between the restored voice signal and the external sound signal and determines that a noise level is equal to or higher than a set value, the alarm signal generation unit 35 generates an alarm signal. On the other hand, if the noise level measurement unit 34 determines that the noise level is lower than the set value, the sound processing unit 36 is driven, and the restored voice signal and the external voice signal are selectively processed.

Figure 3:
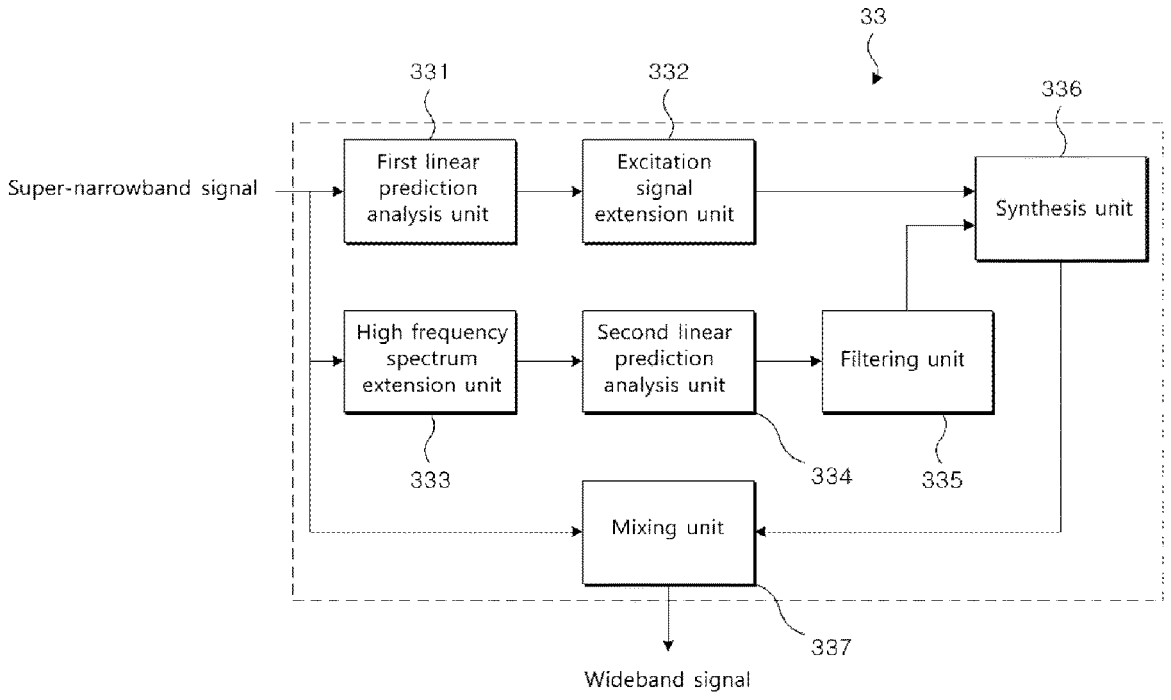
FIG. 3 is a view showing the configuration of an internal voice restoration unit according to an embodiment of the present invention.

FIG. 3 is a view showing the configuration of an internal voice restoration unit according to an embodiment of the present invention.

Referring to FIG. 3, the internal voice restoration unit 33 includes: a first linear prediction analysis unit 331 for determining an excitation signal from an inputted super-narrowband signal; an excitation signal extension unit 332 for generating a sound by outputting the determined excitation signal as a wideband excitation signal through a spectrum folding technique or a Gaussian noise pass band conversion technique; a high frequency spectrum extension unit 333 for extending a super-narrowband signal to a wideband signal including a high frequency band signal by multiplying (N times) the frequency of the super-narrowband signal; a second linear prediction analysis unit 334 for predicting and determining the high frequency band signal from the extended wideband signal; a filtering unit 335 for filtering the high frequency band signal outputted from the second linear prediction analysis unit 334; a synthesis unit 336 for synthesizing the high frequency band signal outputted from the filtering unit 335 and the wideband excitation signal outputted from the excitation signal extension unit 332; and a mixing unit 337 for mixing the high frequency signal outputted from the synthesis unit 336 and the super-narrowband signal. Like this, the internal voice restoration unit 33 of the present invention is largely configured of a high frequency signal generation unit for generating a high frequency signal by synthesizing the excitation signal extended from the inputted super-narrowband signal and the high frequency band signal generated by multiplying, extending and filtering the frequency of the super-narrowband signal, and the mixing unit 337 for mixing the high frequency signal and the super-narrowband signal.

For example, if the high frequency spectrum extension unit 333 up-samples the super-narrowband signal (0 to 2 KHz) by doubling the signal, the up-sampled signal is sampled at 4 KHz. Therefore, the signal outputted from the high frequency spectrum extension unit 333 is the same as that of 0 to 4 KHz band and has a spectrum the same as that of a folded version of the input signal at a high frequency band of 4 to 8 KHz. The high frequency band signal is predicted using this spectrum. Therefore, the filtering unit 335 extracts a voice signal of 4 to 8 KHz band. Then, the synthesis unit 336 synthesizes the voice signal of 0 to 4 KHz band and the voice signal of 4 to 8 KHz band, and subsequently, a sound of high frequency range is finally restored by mixing the high frequency voice outputted from the synthesis unit 336 and the super-narrowband signal (0 to 2 KHz) before the extension.

The internal voice restoration unit 33 of the present invention configured like this makes it possible to restore a sound of high frequency range although a super-narrowband signal is inputted into the internal microphone 1. That is, a high-pitched sound restoration algorithm generally extends a frequency of 0 to 4 KHz up to 8 KHz, whereas in the present invention, a super-narrowband signal lower than 2 KHz, inputted into the internal microphone 1, is restored. Moreover, in the present invention, a sound of high frequency range can be restored although the computation volume is reduced remarkably.

In the present invention, an operation of predicting and extending a frequency through an algorithm based on linear prediction encoding is not performed, and a simple frequency extension is performed through a high frequency spectrum extension. That is, an operation of predicting a frequency and generating and extending the frequency in real-time is omitted, and only the frequency is extended using a rectifier, spectrum folding, and a modulation technique. Therefore, the computation volume can be reduced greatly.

When a wideband signal is outputted as the high frequency spectrum extension unit 333 simply extends only the frequency like this, a linear prediction analysis is performed on the wideband signal, and the signal is only simply filtered using a filter without performing frequency extension through linear prediction modelling. That is, a sound close to an original sound (of high frequency range) is filtered without extending the bandwidth. Then, if the filtered result and the result of extending the excitation signal are synthesized, a high frequency signal is generated. Subsequently, if the high frequency signal is finally mixed with the super-narrowband signal received through the internal microphone 1, a sound of high frequency range is restored.

Then, here, a method of monitoring an earphone wearing state of the present invention using a device configured as described above will be described.

Figure 4:
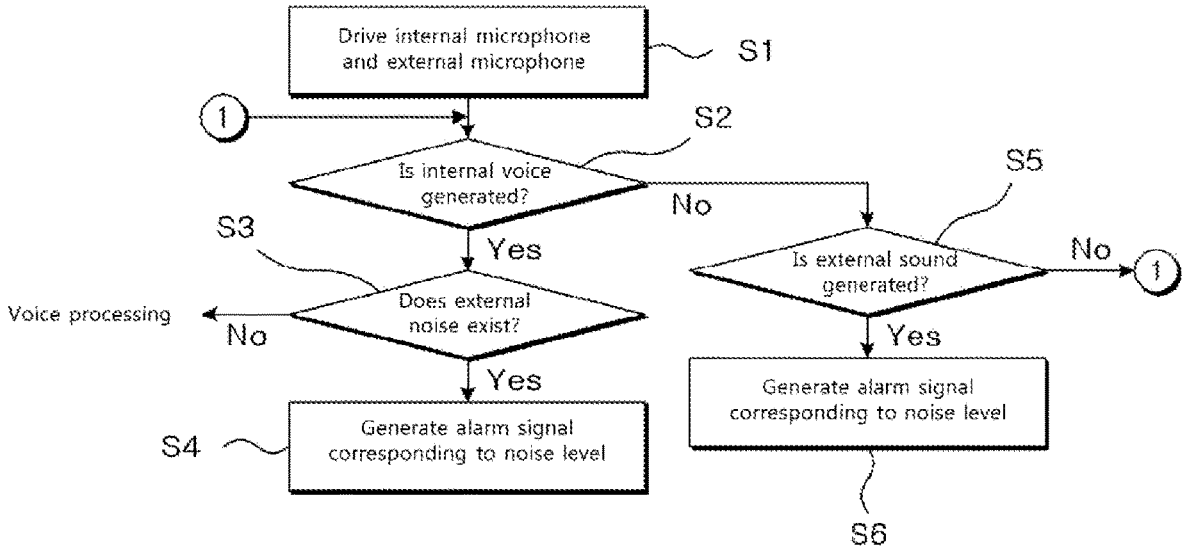
FIG. 4 is a flowchart illustrating a method of monitoring an earphone wearing state according to an embodiment of the present invention.

FIG. 4 is a flowchart illustrating a method of monitoring an earphone wearing state according to an embodiment of the present invention.

Referring to FIG. 4, in response to driving of the internal microphone 1 and the external microphone 2, the internal microphone 1 receives an internal voice generated in real-time, and the external microphone 2 receives an external sound selectively including an external voice and an external noise generated in real-time.

At this point, if an internal voice is generated, whether an external noise exists is determined using a difference between an external voice signal and an internal voice signal. Alternatively, in determining whether an external noise exists, a signal (high frequency signal) exceeding a narrowband low frequency signal generated in an ear canal by individual operation of the internal microphone 1 may be regarded as an external noise.

When an external noise exists, an original voice signal is restored from the internal voice signal, and then a noise level is measured using a difference between the restored voice signal and the external voice signal, and an alarm corresponding to the noise level is generated, or the restored voice signal and the external voice signal are selectively processed. On the other hand, when an external noise does not exist at a time point of generating the internal voice, the internal voice signal and the external voice signal are selectively processed.

On the other hand, when an internal voice is not generated, whether an external sound is generated is determined, and if there exists an external sound (external noise), a noise level is measured, and an alarm corresponding to the noise level is generated, or the process returns to ①.

Figure 5:
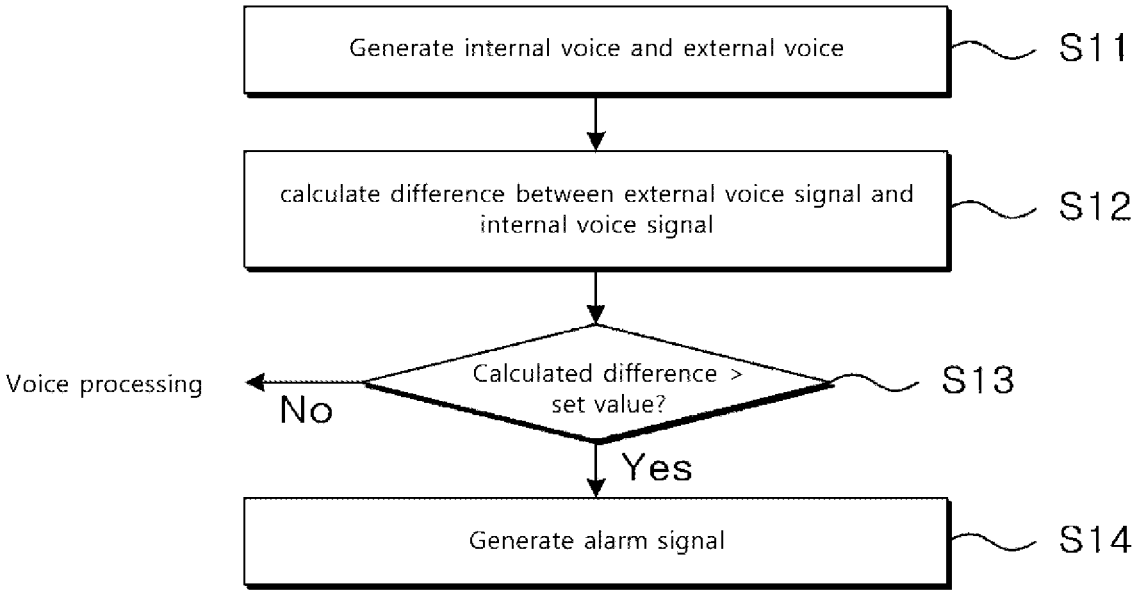
FIG. 5 is a control flowchart of a case when an internal voice is generated according to an embodiment of the present invention.

FIG. 5 is a control flowchart of a case when an internal voice is generated according to an embodiment of the present invention.

Referring to FIG. 5, if an internal voice is generated, the internal microphone 1 generates an internal voice signal. At this point, if an internal voice signal is generated, an external voice signal is also generated without fail. It is since that the internal voice transferred through the ear canal and the external voice transferred from the vocal cords to the outside of the oral cavity are generated together.

Figure 6:
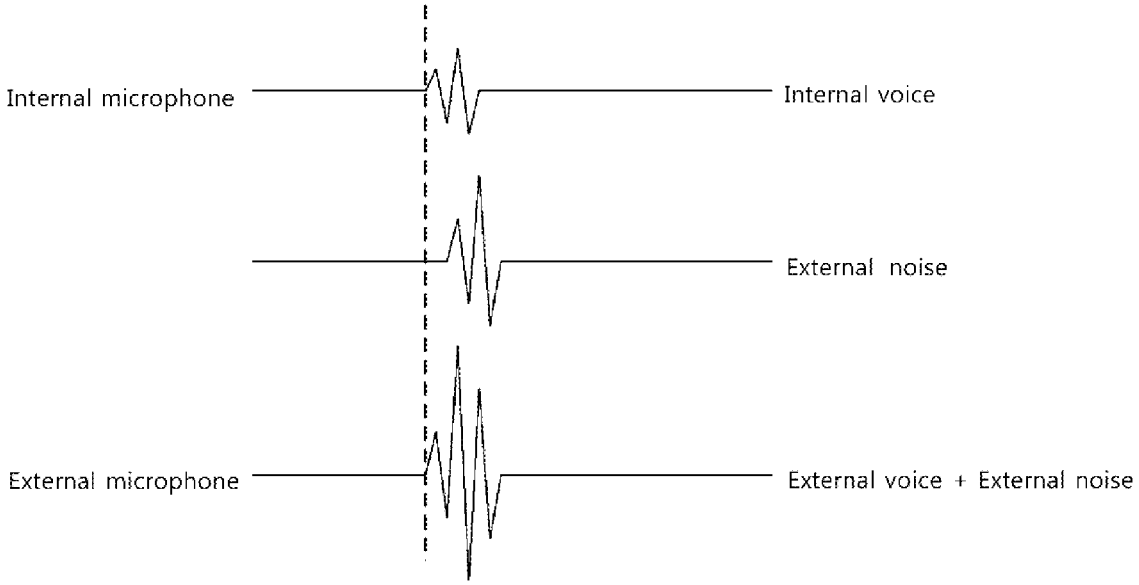
FIG. 6 is a view showing a waveform when an internal voice and an external noise are generated together in the present invention.

At this point, as shown in FIG. 6, the external noise may be generated at a time point of generating the internal voice. That is, the external sound may be configured of an external voice and an external noise.

Whether an external noise is generated at a time point of generating the internal voice may be confirmed through a difference between the external voice signal and the internal voice signal. That is, when the difference between the external voice signal and the internal voice signal is lower than a set value, it is determined that there is no external noise, and when the difference between the external voice signal and the internal voice signal is equal to or lower than the set value, it is determined that there is an external noise.

When an external noise exists, an original voice signal is restored from the internal voice signal, and then a noise level is measured using a difference between the restored voice signal and the external voice signal. If the noise level is equal to or higher than a set value as a result of measuring the noise level, an alarm is generated, and if the noise level is lower than the set value, the restored voice signal and the external voice signal are selectively processed.

On the other hand, when an external noise does not exist at a time point of generating the internal voice, the internal voice signal and the external voice signal are selectively processed.

Figure 7:
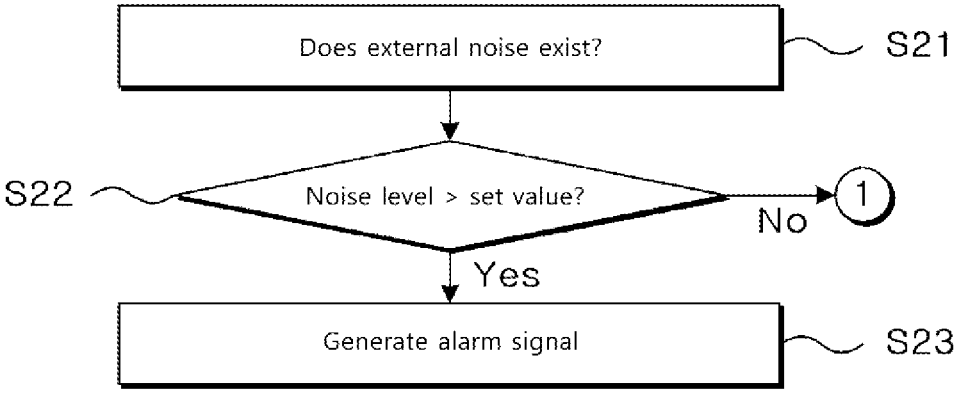
FIG. 7 is a control flowchart of a case when an internal voice is not generated according to an embodiment of the present invention.

FIG. 7 is a control flowchart of a case when an internal voice is not generated according to an embodiment of the present invention.

Figure 8:
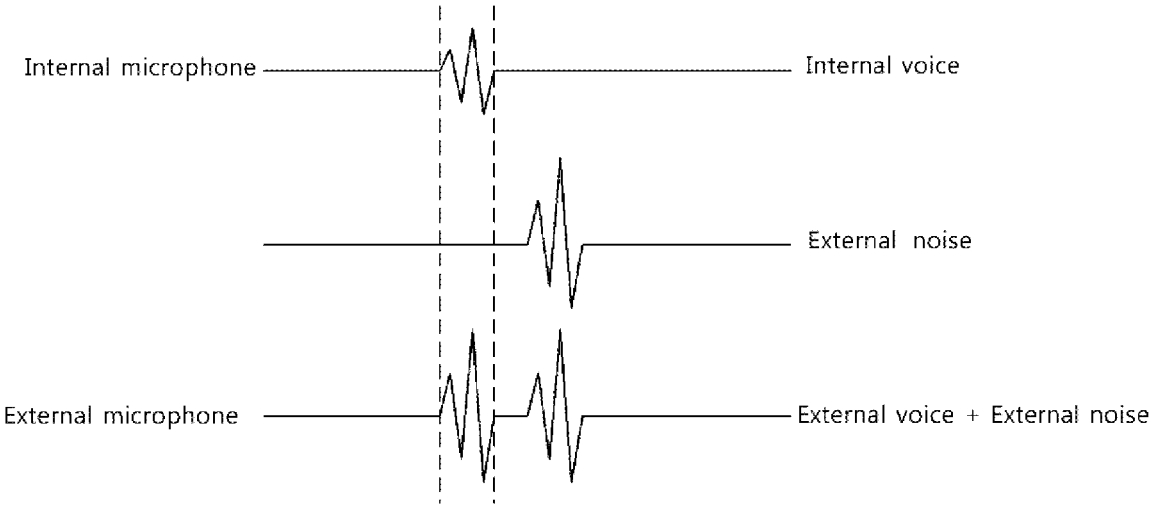
FIG. 8 is a view showing a waveform when an internal voice and an external noise are separately generated in the present invention.

Referring to FIG. 7, when the time point of generating the internal voice is different from the time point of generating the external sound, i.e., when only the external sound is generated, it may be defined as only the external noise exists as shown in FIG. 8.

Therefore, in this case, a noise level of the external sound (external noise) is immediately measured. If the noise level is equal to or higher than a set value, an alarm is generated, and if the noise level is lower than the set value, the process returns to ①.

Like this, the technique of the device and method for monitoring an earphone wearing state according to the present invention can be applied to earphones, a headset and the like and improve sound quality when a user makes a phone call or listens to music by utilizing external noises. It may confirm existence of external noise using the internal microphone 1 installed to be physically blocked from the outside and the external microphone 2 installed outside and may as well perform functions such as reproducing a high quality sound, generating an alarm corresponding to the external noise level, and the like.

The technical spirit of the present invention has been described above through several embodiments.

It is apparent that those skilled in the art may diversely modify or change the embodiments described above from the description of the present invention. In addition, it is apparent that although it is not explicitly shown or described, those skilled in the art may make modifications of diverse forms including the spirit of the present invention from the description of the present invention, and this still falls within the scope of the present invention. The embodiments described above with reference to the accompanying drawings are described for the purpose of describing the present invention, and the scope of the present invention is not limited to the embodiments.

The invention claimed is:

1. A device for monitoring an earphone wearing state, the device comprising:

an internal microphone for receiving an internal voice that is generated by a wearer of the device and transferred through an ear of the wearer and for generating an internal voice signal using the received internal voice;

an external microphone for receiving an external sound including at least one of an external voice that is generated by the wearer and transferred from vocal cords to the outside of an oral cavity of the wearer and an external noise, and for generating an external sound signal using the received external sound;

a control unit for determining, based on the internal voice signal and the external sound signal, whether or not to generate an alarm signal that indicates an improper earphone wearing state; and an alarm unit for generating an alarm in response to the alarm signal, wherein, responsive to the internal voice generated by the wearer and responsive to a high frequency signal that exceeds a frequency band of the internal voice and is included in the internal voice signal, the control unit considers the high frequency signal as a noise and generates the alarm signal.

2. The device according to claim 1, wherein the control unit includes:

an internal voice generation determination unit for determining whether the internal voice is generated;

a noise existence determination unit for determining whether the external noise is included in the external sound using a difference between the external sound signal and the internal voice signal, when the internal voice is generated;

an internal voice restoration unit for restoring an original voice from the internal voice signal and generating a restored voice signal, when the external noise is included in the external sound;

a noise level measurement unit for measuring an external noise level from a difference between the restored voice signal and the external sound signal and external sound signals generated at a time point other than a time of generating the internal voice signal;

an alarm signal generation unit for comparing the measured external noise level with a value set in advance, and generating an alarm signal when the measured external noise level is equal to or higher than the set value; and a sound processing unit for comparing, when the external noise is not included in the external sound, the measured external noise level with the value set in advance and processing at least one of the internal voice signal and the external voice signal when the measured external noise level is lower than the set value.

3. The device according to claim 2, wherein the internal voice restoration unit includes:

a first linear prediction analysis unit for determining an excitation signal from an inputted super-narrowband signal;

an excitation signal extension unit for generating a sound by outputting the determined excitation signal as a wideband excitation signal through a spectrum folding technique or a Gaussian noise pass band conversion technique;

a high frequency spectrum extension unit for extending a super-narrowband signal to a wideband signal including a high frequency band signal by multiplying the frequency of the super-narrowband signal;

a second linear prediction analysis unit for predicting and determining the high frequency band signal from the extended wideband signal;

a filtering unit for filtering the high frequency band signal;

a synthesis unit for synthesizing the high frequency band signal outputted from the filtering unit and the wideband excitation signal outputted from the excitation signal extension unit; and a mixing unit for mixing the high frequency signal outputted from the synthesis unit and the super-narrowband signal.

4. A method of monitoring an earphone wearing state, the method comprising the steps of:

receiving, from an internal microphone, an internal voice signal generated using an internal voice, the internal voice being generated by a wearer of the earphone and transferred through an ear of the wearer;

receiving, from an external microphone, an external sound signal generated using an external sound, the external sound including at least one of an external voice that is generated by the wearer and transferred from vocal cords to the outside of an oral cavity of the wearer and an external noise; and determining, based on the internal voice signal and the external sound signal, whether or not to generate an alarm signal that indicates an improper earphone wearing state; and responsive to the internal voice generated by the wearer and responsive to a high frequency signal that exceeds a frequency band of the internal voice and is included in the internal voice signal, considering the high frequency signal as a noise and generating the alarm signal.

5. The method according to claim 4, further comprising the steps of:

(i) when the external noise exists, restoring an original voice signal from the internal voice signal;

measuring a noise level using a difference between the restored voice signal and the external voice signal;

comparing the measured noise level with a value set in advance;

if the measured noise level is equal to or higher than the value, generating the alarm signal; and if the measured noise level is lower than the value, processing at least one of the internal voice signal and the external voice signal; and (ii) when the external noise does not exist, processing at least one of the restored voice signal and the external voice signal.

6. The method according to claim 4, further comprising the steps of:

determining, if the internal voice is not generated, whether the external sound is generated; and measuring, if the external sound exists, a noise level of the external sound, and determining whether or not to generate an alarm corresponding to the noise level.

* * * * *